United States Patent [19]

Batiste et al.

[11] Patent Number: 4,726,580

[45] Date of Patent: Feb. 23, 1988

[54] EXERCISE APPARATUS

[76] Inventors: Stanley Batiste, 320 Evelyn Ave., Roseville, Calif. 95678; Charles Manly, 10340 Newton Way, Rancho Cordova, Calif. 95670

[21] Appl. No.: 937,842

[22] Filed: Dec. 4, 1986

[51] Int. Cl.[4] ..... A63B 21/30

[52] U.S. Cl. ..... 272/68; 272/67; 272/141; 272/135

[58] Field of Search ..... 272/130, 135, 141, 67, 272/68, 143, DIG. 1, 136, 140, 142; 128/26; 73/379, 380, 381; D8/14.1; 84/467; 273/64

[56] References Cited

U.S. PATENT DOCUMENTS

| | | | |
|---|---|---|---|
| 714,477 | 11/1902 | Haenze | 73/380 |
| 1,638,196 | 8/1927 | Guth | 272/68 |
| 2,650,744 | 9/1953 | Dirksen | D8/14.1 X |
| 3,029,076 | 4/1962 | Andersen | 272/141 X |
| 3,216,259 | 11/1965 | Bendix, Jr. . | |
| 3,738,651 | 6/1973 | Norman et al. . | |
| 3,807,729 | 4/1974 | Sigma . | |
| 4,021,040 | 5/1977 | Inoue . | |
| 4,129,297 | 12/1978 | Dolan | 272/67 |
| 4,384,715 | 5/1983 | Savio et al. | 272/141 X |
| 4,513,962 | 4/1985 | Robson et al. | 272/68 |

*Primary Examiner*—Richard J. Apley
*Assistant Examiner*—Howard Flaxman
*Attorney, Agent, or Firm*—Henderson & Sturm

[57] ABSTRACT

An exercise apparatus (10) comprising a housing unit (11) having relatively moveable upper (17) and lower (18) housing members containing a spring element (12) which surrounds a force transmitting unit (13) and is disposed intermediate an adjustable spring tensioning means (16); wherein, a force imparting lever unit (15) is pivotally connected to the housing unit (11) and further operatively connected to the force transmitting unit (13) via a toggle linkage (14).

4 Claims, 4 Drawing Figures

FIG. 1.
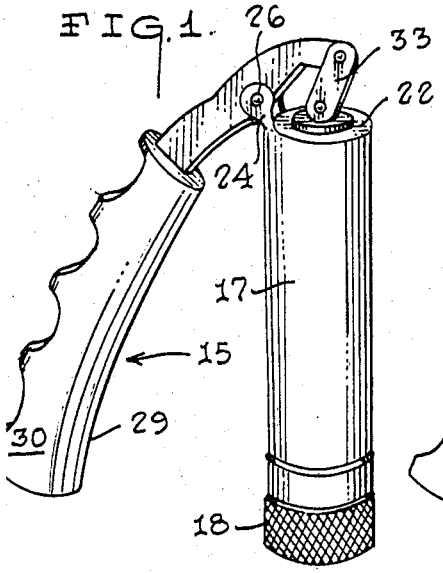
FIG. 2.
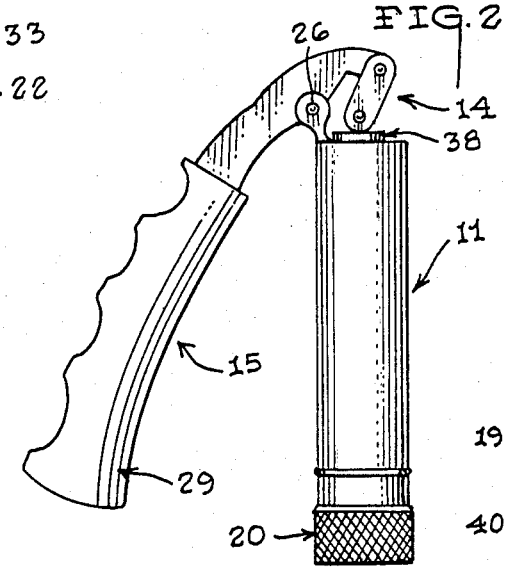
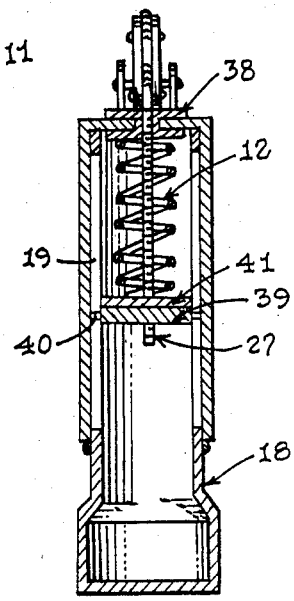
FIG. 3.
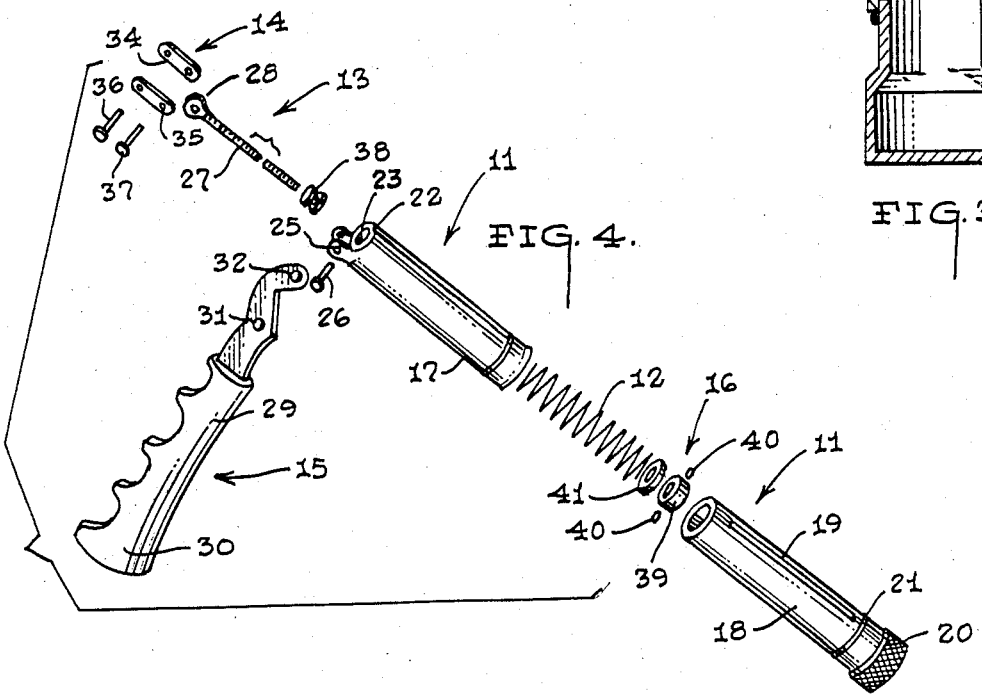
FIG. 4.

EXERCISE APPARATUS

TECHNICAL FIELD

The present invention relates generally to the field of exercise apparatus, and more specifically to a device employed primarily to strengthen the fingers, wrist, and forearm of a user.

BACKGROUND OF THE INVENTION

The prior art is replete with diverse constructions developed specifically to assist the user in increasing the strength of the users wrist, fingers and forearms.

Representative examples of these prior art constructions may be seen by reference to U.S. Pat. Nos: 4,513,962; 3,807,729; 3,738,651; 3,216,259; and, 4,021,040. The basic physical principle employed in the majority of the aforementioned prior art constructions involves the application of force on the users part to overcome the spring biased resistance provided by the particular device in question.

Bendix, Jr., U.S. Pat. No. 3,216,259 discloses a plurality of spring elements interposed between moveable portions of his apparatus housing; wherein, the user will experience different simultaneous resistance relative to his fingers and thumb.

Norman, U.S. Pat. No. 3,738,651 discloses a plurality of individually spring biased elements used to provide isolated resistance to the users fingers; wherein, each of the individual spring biased elements are provided with bias adjustment elements to vary the resistance provided by each spring.

Inoue, U.S. Pat. No. 4,021,040 discloses a barbell construction; wherein, the barbell handle is provided with a grasp enhancing portion in the form of a leaf spring biased finger grip element.

Sigma, U.S. Pat. No. 3,807,729 discloses a heavy duty coil spring having outwardly projecting arms provided with hand grip portions; wherein, the exercise device is further provided with a counter for registering the number of times that the user deflects the coil spring a given amount.

Robson et al., U.S. Pat. No. 4,513,962 represents the closest prior art from both a functional and structural standpoint with respect to the subject matter of the present invention. The Robson et al. construction comprises a cylindrical housing containing a spring biasing element that is operatively connected to a pivoted lever arm; wherein, the user grasps the cylinder and the lever to overcome the resistance imparted by the spring element.

While all of the aforementioned prior art constructions are considered to be adequate for the basic purpose and function for which they have been designed; there still remained significant areas wherein structural and functional improvements could be incorporated into an exercising apparatus using the basic principle of overcoming a spring biased resistance; and, the present invention represents such an improved apparatus.

SUMMARY OF THE INVENTION

Briefly stated, the exercise apparatus that forms the basis of the present invention comprises a housing unit containing a spring element which is operatively captured by a force transmitting unit; wherein, one end of the force transmitting unit is operatively connected to both the housing unit and a force imparting lever unit via a toggle linkage.

In addition, the force transmitting unit is further provided with adjustable spring tensioning means; wherein, the spring tensioning means cooperate with relatively moveable portions of the housing unit.

As will be described in greater detail further on in the specification, the structural components of the exercise apparatus of this invention cooperate with one another to translate the pivotal actuation of the lever unit relative to the housing unit, into an axially directed force component with respect to the force transmitting unit. In addition, the housing unit comprises two relatively rotatable housing portions; wherein, one of the housing portions is operatively associated with the adjustable spring tensioning means on the force transmitting unit; wherein, rotation of the two housing portions will produce an adjustment of the spring tensioning of the exercise apparatus.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a perspective view of the exercise apparatus of this invention;

FIG. 2 is a front elevation view of the apparatus;

FIG. 3 is a cross-sectional view of the apparatus; and,

FIG. 4 is an exploded perspective view showing the structural components of the apparatus.

BEST MODE FOR CARRYING OUT THE INVENTION

As can be seen by reference to the drawings and in particular to FIGS. 1 and 4, the exercise apparatus that forms the basis of the present invention is designated generally by reference numeral (10). The exercise apparatus (10) comprises in general: a housing unit (11); a spring element (12); a force transmitting unit (13); a toggle linkage (14); a force imparting lever unit (15); and, an adjustable spring tensioning means (16). These structural components will now be described in seriatim fashion.

As can best be seen by reference to FIG. 4, the housing unit (11) comprises: an upper generally cylindrical housing member (17); and, a lower generally cylindrical housing member (18). The lower cylindrical housing member (18) is hollow and is provided with at least one elongated, vertically aligned aperture (19) that extends through one side of the housing member (18). In addition, the base of the lower housing member (18) is provided with: a knurled knob element (20) that also serves as a closure for the bottom of the lower housing member (18); and, a raised shoulder element (21) is radially disposed on the lower housing member (18) proximate to, but spaced from the knob element (20).

The upper cylindrical housing member (17) is provided with an inwardly extending shoulder element (22) that surrounds a centrally disposed aperture (23) formed in the top of the upper housing member. In addition, the upper housing member (17) is further provided with a pair of ear elements (24) having aligned apertures (25) dimensioned to receive a first pivot element (26).

The force transmitting unit (13) comprises an elongated threaded riser (27) having an enlarged eyelet element (28) provided on its upper end.

The force imparting lever unit (15) comprises an elongated handle member (29) provided with a hand grip element (30) on its lower end and further provided with a first pivot aperture (31) spaced from the upper end of the handle member (29) and a second pivot aperture (32) disposed proximate the upper end of the handle member (29).

The toggle linkage (14) comprises a pair of toggle link members (33) having upper (34) and lower (35) aligned pivot apertures formed proximate their ends; wherein, the upper pivot apertures (34) are dimensioned to receive a second pivot element (36) and the lower pivot apertures (35) are dimensioned to receive a third pivot element (37).

As can best be appreciated by reference to FIGS. 3 and 4, the central aperture (23) in the upper housing member (18) is provided with a bushing element (38) that loosely receives the threaded riser bolt (27). The adjustable spring tensioning means (16) is operatively connected to the lower end of the threaded riser bolt (27) and comprises an internally threaded riser member (39) provided with at least one outwardly projecting riser pin (40); wherein, the riser pin (40) is dimensioned to be slideably received in the at least one elongated aperture (19) provided in the lower housing member (18).

The assembly of the exercise apparatus (10) will be described as depicted from left to right in FIG. 4. The elongated handle member (29) is pivotally secured to the upper housing member (17) by inserting the first pivot element (26) through the first pivot aperture (31) in the handle member (29) and the aligned apertures (25) in the ear elements (24) on the upper housing member (17). The toggle linkage (14) is connected to the handle member (29) by inserting the second pivot element (36) through the second pivot aperture (32) in the handle element (29) and the upper pivot aperture (34) in the toggle link members (33).

The operative connection between the toggle linkage (14) and the force transmitting unit (13) is accomplished by inserting the third pivot element (37) through the lower pivot apertures (35) in the toggle link members (33) and the eyelet element (28) in the threaded riser bolt (27).

The threaded end of the riser bolt (27) is loosely received in the bushing element (38) and the upper housing member (17). In addition the threaded end of the riser bolt (27) extends through the elongated coil spring element (12) and is threadedly engaged with the riser member (39).

At this point the riser member (39) is inserted into the lower housing member (18) and the riser pin (40) is operatively engaged with the riser member (39) through the elongated aperture (19) in the lower housing member (18) to complete the basic assembly of the exercise apparatus (10).

As can best be seen by reference to FIGS. 3 and 4, in the preferred embodiment of the invention, the riser member (39) is provided with a plurality of outwardly projecting riser pins (40) which cooperate with a plurality of elongated apertures (19) in the lower housing member (18). In addition, the exercise apparatus (10) is further provided with an optional washer element (41) which is disposed intermediate the lower end of the spring element (12) and the top of the riser member (39).

By now it should be appreciated that an exercise apparatus (10) built in accordance with the foregoing teachings will allow the pivotal rotation of the handle member (29) about the first pivot element (26) to be transformed into a vertical reciprocation of the threaded riser bolt (27) relative to the housing unit (11) by virtue of the provision of the toggle linkage (14) intermediate the handle member (29) and the threaded riser bolt (27).

The compression of the spring element (12) provides resistance to the user; and, the spring biasing force of the apparatus (10) may be varied by relative rotation of the upper housing member (17) with respect to the lower housing member (18); wherein, the riser member (39) may be displaced relative to the riser bolt (27).

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

We claim:

1. An exercise apparatus consisting of:

a housing unit comprising a generally hollow cylindrical upper housing member and a generally hollow cylindrical lower housing member; wherein, the housing members are relatively movable with respect to one another; the lower housing member is provided with: a pair of opposed elongated vertically aligned apertures; a knob element; and, a raised shoulder element wherein the raised shoulder element is disposed proximate to, but spaced from, said knob element and, the upper housing member is provided with a pair of ear elements having aligned apertures;

a force transmitting unit comprising an elongated threaded riser bolt having an eyelet formed on its upper end; wherein, the lower end of the riser bolt extends into the housing unit;

a tensioning means operatively associated with the lower housing member and operatively connected to the lower end of said elongated threaded riser bolt; wherein, said tensioning means comprises an internally threaded riser member provided with a pair of outwardly projecting riser pins that operatively engage said pair of vertically disposed apertures in the lower housing member;

a spring element provided within the housing unit and operatively associated with the tensioning means and both of said housing members;

a force imparting a lever unit pivotally connected to the upper housing member; comprising an elongated handle member provided with a hand grip element on its lower end, and further provided with a first pivot aperture spaced from the upper end of the handle member, and a second pivot aperture disposed proximate the upper end of the handle member within, the pivotal connection between said force imparting unit and said housing unit comprises: a first pivot element that projects through said first pivot aperture in the handle member and the aligned apertures in said ear elements; and a toggle linkage operatively connected to the force imparting lever unit and the force transmitting unit; wherein, the toggle linkage comprises at least one toggle link member having upper and lower pivot apertures; and the operative connection between said toggle linkage and said force imparting unit comprises: a second pivot element that extends through the said second pivot aperture in the handle member and the upper pivot aperture in the at least one toggle link member; and, a third pivot element that extends through the lower pivot aperture in said at least one toggle link member and the eyelet in the upper end of said threaded riser bolt.

2. An exercise apparatus comprising:

a housing unit comprising a generally hollow cylindrical upper housing member and a generally hollow cylindrical lower housing member; wherein, the housing members are relatively movable with respect to one another; the lower housing member is provided with: a pair of opposed elongated vertically aligned apertures; a knob element, and, a raised shoulder wherein the raised shoulder element is disposed proximate to, but spaced from, said knob element and, the upper housing member is provided with a pair of ear elements having aligned apertures;

a force transmitting unit comprising an elongated threaded riser bolt having an eyelet formed on its upper end; wherein, the lower end of the riser bolt extends into the housing unit;

a tensioning means operatively associated with the lower housing member and operatively connected to the lower end of said elongated threaded riser bolt;

a spring element provided within the housing unit and operatively associated with the tensioning means and both of said housing members;

a force imparting a lever unit pivotally connected to the upper housing member; comprising an elongated handle member provided with a hand grip element on its lower end, and further provided with a first pivot aperture spaced from the upper end of the handle member, and a second pivot aperture disposed proximate the upper end of the handle member; and, a toggle linkage operatively connected to the force imparting lever unit and the force transmitting unit; wherein, the toggle linkage comprises at least one toggle link member having upper and lower pivot apertures; and the operative connection between said toggle linkage and said force imparting unit comprises: a second pivot element that extends through the said second pivot aperture in the handle member and the upper pivot aperture in the at least one toggle link member; and, a third pivot element that extends through the lower pivot aperture in said at least one toggle link member and the eyelet in the upper end of said threaded riser bolt.

3. The exercise apparatus as in claim 2, wherein said tensioning means comprises:

an internally threaded riser member provided with a pair of outwardly projecting riser pins that operatively engage said pair of vertically disposed apertures in the lower housing member.

4. The exercise apparatus as in claim 3, wherein the pivotal connection between said force imparting unit and said housing unit comprises:

a first pivot element that projects through said first pivot aperture in the handle member and the aligned apertures in said ear elements.

* * * * *